US007796091B2

(12) United States Patent
Ueda

(10) Patent No.: US 7,796,091 B2
(45) Date of Patent: Sep. 14, 2010

(54) THREE-AXIS ANTENNA, ANTENNA UNIT AND RECEIVING DEVICE

(75) Inventor: Hozumi Ueda, Tokyo (JP)

(73) Assignee: Sumida Corporation, Tokyo (JP)

( * ) Notice: Subject to any disclaimer, the term of this patent is extended or adjusted under 35 U.S.C. 154(b) by 0 days.

(21) Appl. No.: 12/461,910

(22) Filed: Aug. 27, 2009

(65) Prior Publication Data

US 2010/0066626 A1 Mar. 18, 2010

Related U.S. Application Data

(62) Division of application No. 10/592,428, filed on Sep. 11, 2006, now Pat. No. 7,616,166.

(30) Foreign Application Priority Data

Mar. 12, 2004 (JP) ..... 2004-071481

(51) Int. Cl.
*H01Q 7/08* (2006.01)

(52) U.S. Cl. ..... 343/788; 343/787; 343/728; 343/742; 343/867; 343/702

(58) Field of Classification Search ..... None
See application file for complete search history.

(56) References Cited

U.S. PATENT DOCUMENTS

| | | | | |
|---|---|---|---|---|
| 6,924,767 | B2 * | 8/2005 | Kitahara et al. | 343/702 |
| 6,940,461 | B2 * | 9/2005 | Nantz et al. | 343/713 |
| 7,068,223 | B2 | 6/2006 | Yoshida et al. | |
| 7,295,168 | B2 * | 11/2007 | Saegusa et al. | 343/788 |
| 2004/0061660 | A1 | 4/2004 | Yoshida et al. | |
| 2005/0151696 | A1 * | 7/2005 | Govari et al. | 343/788 |

FOREIGN PATENT DOCUMENTS

| | | |
|---|---|---|
| EP | 1 489 683 A1 | 12/2004 |
| EP | 1 376 762 B1 | 2/2006 |
| JP | 2003-92509 | 3/2003 |
| JP | 2004-32754 | 1/2004 |
| JP | 2004-88139 | 3/2004 |
| JP | 2004-159348 | 6/2004 |
| WO | WO 03/075403 A1 | 9/2003 |

OTHER PUBLICATIONS

English-language International Search Report issued by the Japanese Patent Office on Jul. 5, 2005, for International Patent Application No. PCT/JP2005/004218.

* cited by examiner

*Primary Examiner*—Trinh V Dinh
(74) *Attorney, Agent, or Firm*—Finnegan, Henderson, Farabow, Garrett & Dunner, L.L.P.

(57) ABSTRACT

To attain sensitivity not deviating in any of XYZ directions. A three-axis antenna with a cross-shaped core 2 having a pair of X-axis arms 22*a*, 22*b* projecting in the X-axis direction in an orthogonal coordinate system and a pair of Y-axis arms 23*a*, 23*b* projecting in the Y-axis direction orthogonal to aforementioned X-axis direction, and having Z-axis winding wire 26 provided in a substantially rectangular frame shape outside the head sections of aforementioned X-axis arms 22*a*, 22*b* and the head sections of aforementioned Y-axis arms 23*a*, 23*b*. Aforementioned Z-axis winding wire is housed in a case having a bottom so as to cover the entire head surfaces of X-axis arms 22*a*, 23*b* and head surfaces of Y-axis arms 23*a*, 23*b* in aforementioned cross-shaped core 2.

3 Claims, 12 Drawing Sheets

(a)

(b)

X axis

Y axis

Z axis

X axis

Y axis

Z axis

THREE-AXIS ANTENNA, ANTENNA UNIT AND RECEIVING DEVICE

This is a division of application Ser. No. 10/592,428, filed Sep. 11, 2006, now U.S. Pat. No. 7,616,166, which is incorporated herein by reference.

TECHNICAL FIELD

The present invention concerns a three-axis antenna, antenna unit and receiving device used in keyless entry systems for wireless operation of locking and unlocking automobile doors, for example.

BACKGROUND

Three axial windings are completed about one core in conventional three-axis antennas. A three-axis antenna that combines a two-axis antenna with a one-axis antenna is disclosed in the gazette of Japanese Kokai Publication 2003-92509. However, the thickness is increased in aforementioned structure because the winding in one axis overlaps the winding in the other axis in a two-axis antenna, which makes it unsuited for miniaturization in terms of height.

In contrast, aforementioned literature presents winding about a cross-shaped core as a two-axis antenna. The need for miniaturization in terms of height is addressed by providing an appropriate three-axis antenna using this.

Patent literature 1: Gazette of Japanese Kokai Publication 2003-92509

SUMMARY

The issue to be resolved is the attainment of sensitivity without deviating in any of XYZ directions in an orthogonal coordinate system with windings about a cross-shaped core.

The three-axis antenna pursuant to the present invention is provided with a cross-shaped core having a pair of X-axis arms projecting in the X-axis direction and a pair of Y-axis arms projecting in the Y-axis direction orthogonal to aforementioned X-axis direction in an orthogonal coordinate system, said X-axis winding wire being completed about aforementioned X-axis arms and Y-axis winding wire being completed about aforementioned Y-axis arms, and Z-axis winding wire being provided in a condition enclosing aforementioned cross-shaped core outside the head sections of aforementioned X-axis arms and the head sections of aforementioned Y-axis arms, wherein aforementioned Z-axis winding wire is housed in a condition so as to cover the entire head surfaces of the X-axis arms and head surfaces of the Y-axis arms in aforementioned cross-shaped core.

Aforementioned X-axis winding wire and Y-axis winding wire in the three-axis antenna pursuant to the present invention each begin from the root section of an arm and extend toward the head section of the arm without encircling said head section. Each winding then spans to the head section of the other arm from which point it continues toward aforementioned root section.

A terminal is connected to each winding origin and each winding terminus of the X-axis winding wire, Y-axis winding wire and Z-axis winding wire in the three-axis antenna pursuant to the present invention. In addition, a terminal is connected to the center taps of the X-axis winding wire and the Y-axis winding wire for a total of eight terminals.

The antenna coil unit pursuant to the present invention is provided with a cross-shaped core having a pair of X-axis arms projecting in the X-axis direction and a pair of Y-axis arms projecting in the Y-axis direction orthogonal to aforementioned X-axis direction in an orthogonal coordinate system, said X-axis winding wire being wound about aforementioned X-axis arms and Y-axis winding wire being wound about aforementioned Y-axis arms, Z-axis winding wire provided in a condition enclosing aforementioned cross-shaped core outside the head sections of aforementioned X-axis arms and the head sections of aforementioned Y-axis arms, a case with a bottom housing aforementioned cross-shaped core and aforementioned Z-axis winding wire, the head section of aforementioned X-axis arm and the head section of aforementioned Y-axis arm each being retained when aforementioned cross-shaped core is set in aforementioned case with a bottom, and retaining tabs that determine the position in the Z-axis direction of the X-axis arm and aforementioned Y-axis arm, wherein aforementioned Z-axis winding wire is housed in aforementioned case with a bottom in a condition so as to cover the entire head surfaces of the X-axis arms and head surfaces of the Y-axis arms in aforementioned cross-shaped core.

A terminal is connected to each winding origin and each winding terminus of the X-axis winding wire, Y-axis winding wire and Z-axis winding wire in the antenna coil unit pursuant to the present invention. In addition, a terminal is connected to the center taps of the X-axis winding wire and the Y-axis winding wire for a total of eight terminals.

Aforementioned X-axis winding wire and Y-axis winding wire in the antenna coil unit pursuant to the present invention each begin from the root section of an arm and extend toward the head section of the arm without encircling said head section. Each winding then spans to the head section of the other arm from which point it continues toward aforementioned root section. A projection tab to catch the winding edge is attached to aforementioned retaining tab.

The receiving device pursuant to the present invention is provided with a three-axis antenna that has a cross-shaped core having a pair of X-axis arms projecting in the X-axis direction and a pair of Y-axis arms projecting in the Y-axis direction orthogonal to aforementioned X-axis direction in an orthogonal coordinate system, said X-axis winding wire being wound about aforementioned X-axis arms and Y-axis winding wire being wound about aforementioned Y-axis arms, Z-axis winding wire provided in a condition enclosing aforementioned cross-shaped core outside the head sections of aforementioned X-axis arms and the head sections of aforementioned Y-axis arms and so as to cover the entire head surfaces of the X-axis arms and head surfaces of the Y-axis arms in aforementioned cross-shaped core, also with a first amplifier connected to a terminal that is connected to the winding origin and to the winding terminus of aforementioned X-axis, a second amplifier connected to a terminal that is connected to the winding origin and to the winding terminus of aforementioned Y-axis, a third amplifier connected to the terminal that is connected to the winding origin and to the winding terminus of aforementioned Z-axis, and a reception selection circuit that treats the output from aforementioned first to third amplifiers as received signals, wherein the terminal connected to the center taps of aforementioned X-axis winding wire and aforementioned Y-axis winding wire and the terminal connected to the winding origin edge of aforementioned Z-axis winding wire are grounded.

A terminal is connected to each winding origin edge and each winding terminus edge of the X-axis winding wire, Y-axis winding wire and Z-axis winding wire in the receiving device pursuant to the present invention. In addition, a terminal is connected to the center taps of the X-axis winding wire and the Y-axis winding wire for a total of eight terminals.

Aforementioned X-axis winding wire and Y-axis winding wire in the receiving device pursuant to the present invention each begin from the root section of an arm and extend toward the head section of the arm without encircling said head section. Each winding then spans to the head section of the other arm from which point it continues toward aforementioned root section.

The terminals to the center taps of the X-axis winding wire and the Y-axis winding wire are connected to the circuit board on which aforementioned first to third amplifiers are installed in the receiving device pursuant to the present invention.

The three-axis coil, antenna coil unit and receiving device pursuant to the present invention are provided with an X-axis winding wire that is wound about the X-axis arm and a Y-axis winding wire that is wound about the Y-axis arm of the cross-shaped core as well as a Z-axis winding wire provided in a condition enclosing aforementioned cross-shaped core outside the head sections of aforementioned X-axis arms and the head sections of aforementioned Y-axis arms, so as to cover the entire head surfaces of the X-axis arms and head surfaces of the Y-axis arms in aforementioned cross-shaped core, which means that the magnetic flux numbers entering the terminal of each arm from the Z-axis winding wire proximal to the head section of each arm are roughly equal, thereby attaining sensitivity without deviation concerning any of the XYZ axis winding wires.

The three-axis coil, antenna coil unit and receiving device pursuant to the present invention are provided with a Z-axis winding wire provided in a condition so as to cover the entire head surfaces of the X-axis arms and head surfaces of the Y-axis arms in the cross-shaped core, the X-axis winding wire and Y-axis winding wire each begin from the root section of an arm and extend toward the head section of the arm without encircling said head section. Each winding then spans to the head section of the other arm from which point it continues toward aforementioned root section. Thus, the potential becomes equal at the head section of a pair of X-axis arms and at the head section of a pair of Y-axis arm and the effects of the electric field due to the head section of aforementioned X-axis arm and to the head section of aforementioned Y-axis arm on the Z-axis winding wire provided in a condition enclosing aforementioned cross-shaped core outside the head sections of the X-axis arms and the head sections of the Y-axis arms are equal, thereby attaining sensitivity without deviation concerning the Z axis winding wire.

Miniaturization in terms of height can be attained since the windings do not overlap in the antenna coil unit and the receiving device pursuant to the present invention. The head section of the X-axis arm and the head section of the Y-axis arm are retained when the cross-shaped core is set in a case with a bottom, and a retaining tab that determines the position in the Z-axis direction of the X-axis arm and the Y-axis arm is provided. Consequently, the cross-shaped core, X-axis arm and Y-axis arm can be easily oriented in the vertical direction, and coupling of each arm can be avoided, thereby attaining sensitivity without deviation concerning any of the XYZ axis winding wires.

The objective of attaining sensitivity without deviation concerning any of the XYZ axis winding wires is realized by creating XY-axis winding wires about a cross-shaped core and by installing a Z-axis winding wire in a condition enclosing aforementioned cross-shaped core outside the head sections of the X-axis arms and the head sections of the Y-axis arms. Embodiments of the three-axis coil, antenna coil unit and receiving device pursuant to the present invention are explained below with reference to the appended figures. Those structures in each diagram that are identical are designated by the same notation and a duplicate explanation is omitted.

DESCRIPTION OF THE EMBODIMENTS

Figure 1:
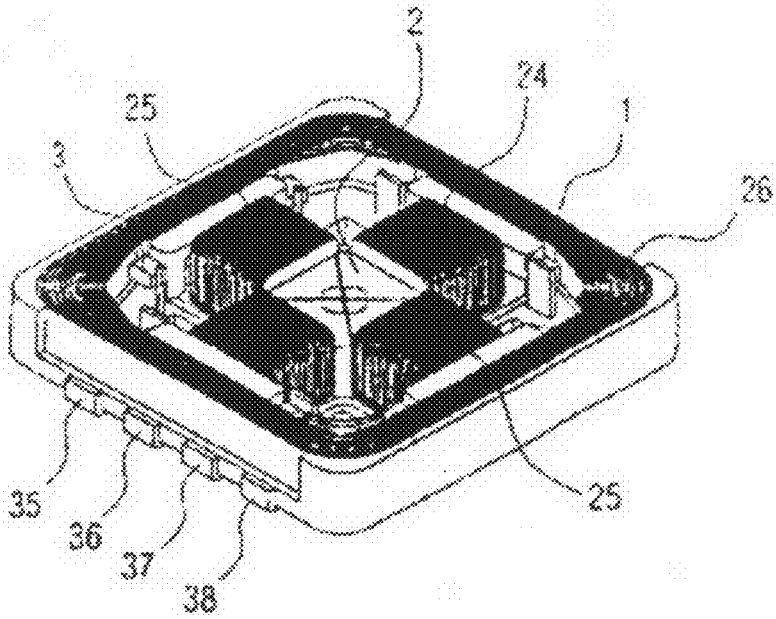
FIG. 1 is a perspective diagram showing an embodiment of the antenna coil unit pursuant to the present invention.
Figure 2:
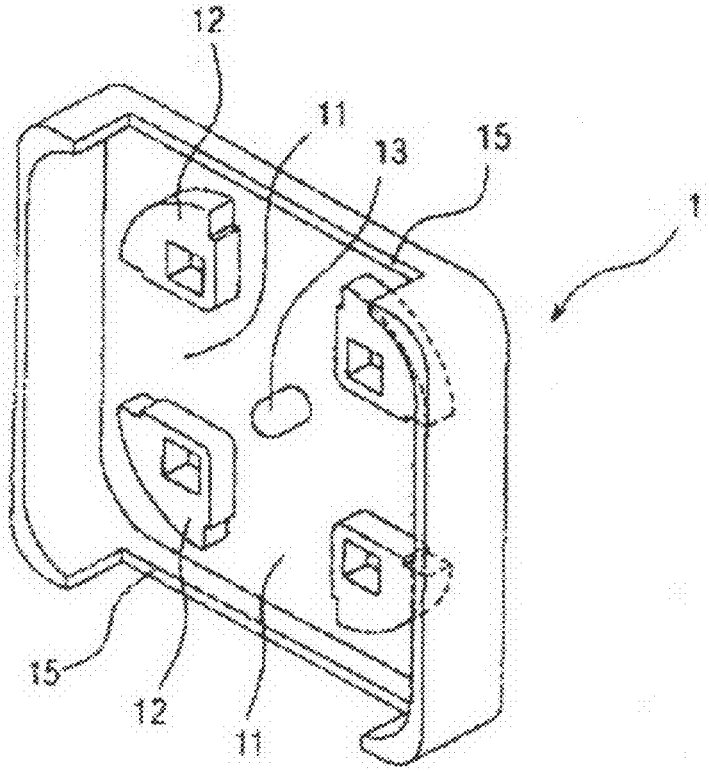
FIG. 2 is a perspective diagram showing the case used in the antenna coil unit pursuant to the present invention.
Figure 4:
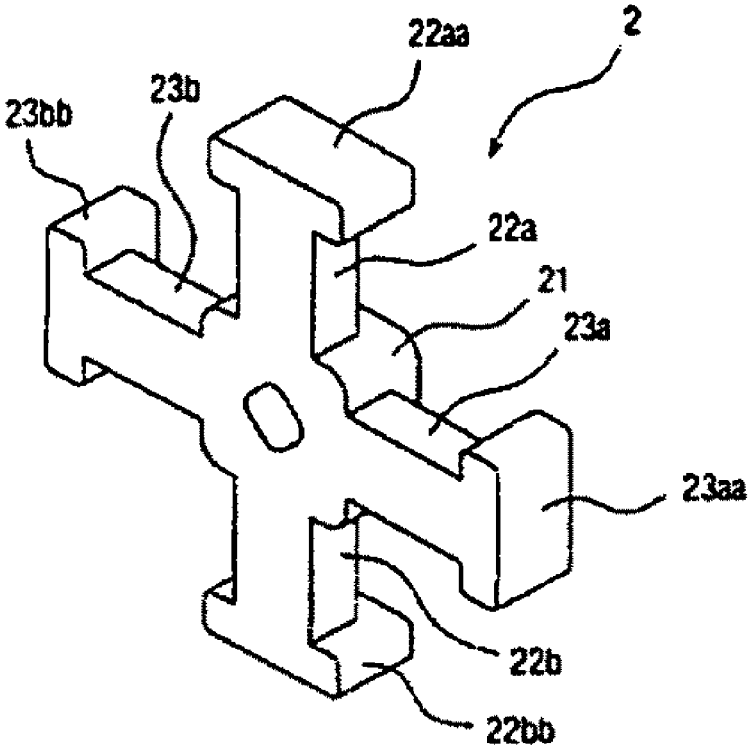
FIG. 4 is a perspective diagram of the condition in which winding wire is not wound in the three-axis antenna pursuant to the present invention.

FIG. 1 presents the antenna coil unit pursuant to Embodiment 1 of the present invention. Case 1, as shown in FIG. 2, a perspective diagram, is a roughly square case with a bottom having a pair of notches cut in the side walls. It may be constructed of resin, for example. Convex members 12 with a one-quarter fan shape are formed in the bottom of case 1 at the four corners to divide the bottom into roughly nine equal portions. Grooves 11 are formed among these convex members 12 so as to match the cross shape of cross-shaped core 2 in order to house aforementioned cross-shaped core 2 shown in FIG. 5 with the completed winding. Cross-shaped core 2 has a prismatic-shaped base section 21 in the center, as shown in FIG. 4. X-axis arms 22*a*, 22*b* and Y-axis arms 23*a*, 23*b* extend outward in four directions at 90-degree angles from base section 21. In addition, projection 13 that is formed in the center of the bottom of case 1, as shown in FIG. 2, is inserted into a hole formed in base section 21 of aforementioned cross-shaped core 2. This structure permits orientation of cross-shaped core 2. Individual head sections 22*aa*, 22*bb*, 23*aa*, 23*bb* of X-axis arms 22*a*, 22*b*, Y-axis arms 23*a*, 23*b* of cross-shaped core 2 are expanded. Magnetic flux is generated and the antenna sensitivity is enhanced since the area of the head section is expanded by so doing.

Figure 3:
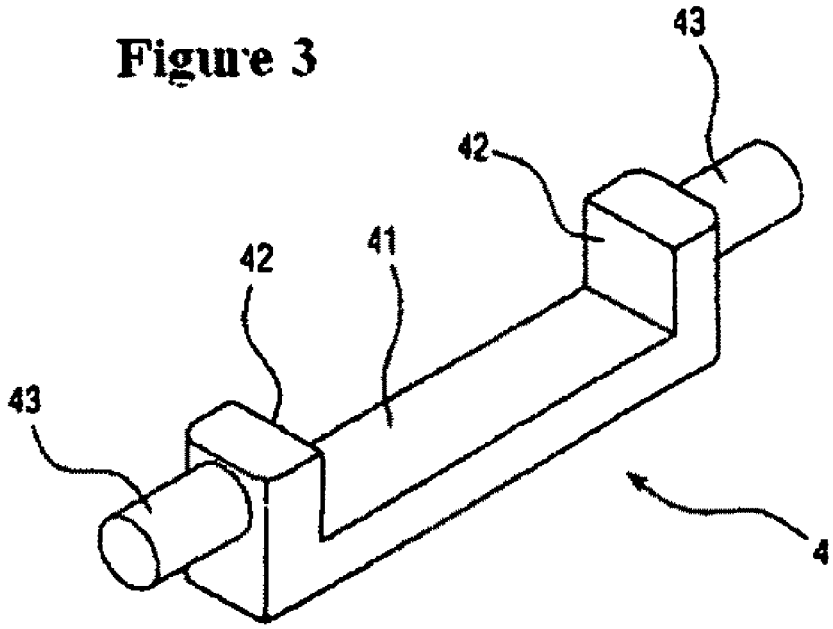
FIG. 3 is a perspective diagram of the retaining tab used in the antenna coil unit pursuant to the present invention.

Retaining tab 4 that retains each head section 22*aa*, 22*bb*, 23*aa*, 23*bb* is shown in FIG. 3. Retaining tab 4 has retaining sections 42, 42 rising from both edges of long seat section 41, and projection tabs 43, 43 that are formed at the upper section of each of the retaining sections 42, 42 so as to protrude outward laterally with the function of preventing downward movement when set in the holes formed at the bottom of case 1. The edges of the coil are caught in projection tabs 43, 43, and the edges of the coil are connected by soldering to the terminals that extend from external terminals 31-38 to projection tabs 43, 43. The surface at retaining tab 4 in contact with each of head sections 22*aa*, 22*bb*, 23*aa*, 23*bb* is formed so as to be flat.

Aforementioned retaining tab 4 is disposed in the concave section formed in convex member 12 that is formed at the bottom of case 1. Cross-shaped core 2 is housed as shown in FIG. 2. Head sections 22*aa*, 22*bb*, 23*aa*, 23*bb* are retained by the corresponding retaining tab 4. In this manner, head sections 22*aa*, 22*bb* of X-axis arms 22*a*, 22*b* and head sections 23*aa*, 23*bb* of Y-axis arms 23*a*, 23*b* are respectively retained, and the orientation of cross-shaped core 2, X-axis arms 22*a*, 22*b*, and of Y-axis arms 23*a*, 23*b* in the height direction can be easily set appropriately since retaining tab 4 determines the Z-axis directional position of X-axis arms 22*a*, 22*b* and of Y-axis arms 23*a*, 23*b* (position in direction of height).

Figure 10:
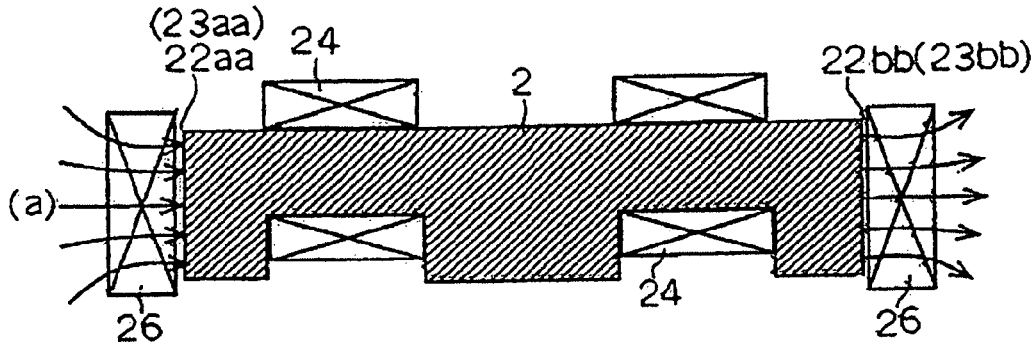
FIG. 10 is a cross-sectional view for explaining the results concerning alignment in the direction of height of the antenna coil unit pursuant to the present invention.
Figure 10:
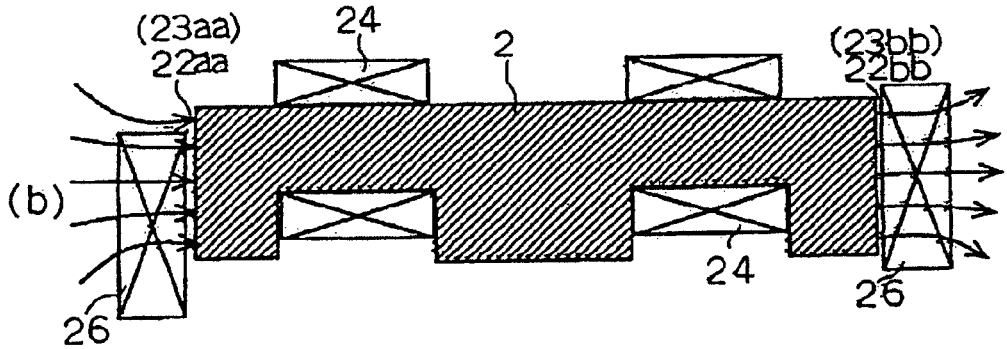

Z-axis winding wire is provided in a condition so as to uniformly cover the head surfaces of X-axis arms 22*a*, 22*b* and the head surfaces of Y-axis arms 23*a*, 23*b* in cross-shaped core 2 (Z-axis winding wire uniformly provided in the portions corresponding to the head sections and in the vertical direction). The magnetic flux number passing through each of the head sections 22*aa*, 22*bb*, 23*aa*, 23*bb* and part of the corresponding Z-axis winding wire (portion corresponding to aforementioned head section) is roughly the same figure at head section 22*aa* and at head section 22*bb*, as shown in FIG. 10 (*a*). Furthermore, the potential difference in the Z-axis winding wire ceases to develop since the figures are roughly the same at head section 23*aa* and head section 23*bb*. Consequently, coupling of the individual axes can be avoided, which permits attainment of sensitivity without deviating in any of XYZ axis winding wires 24-26. In contrast, in a structure in which Z-axis winding wire is provided in a condition so as to not uniformly cover the head surfaces of X-axis arms 22*a*, 22*b* and the head surfaces of Y-axis arms 23*a*, 23*b* in cross-shaped core 2 (Z-axis winding wire not uniformly provided in the portions corresponding to the head sections and in the vertical direction) or in a structure that does not determine the Z-axis directional position (position in direction of height), Z-axis winding wire develops deviation at the head surface of X-axis arms 22*a*, 22*b* or at the head surface of Y-axis arms 23*a*, 23*b* in cross-shaped core 2, as shown in FIG. 10 (*b*). A state is presented in which the magnetic flux number passing through each head surface differs, resulting in the development of a potential difference at the portion of the Z-axis winding wire facing aforementioned head surface.

Figure 5:
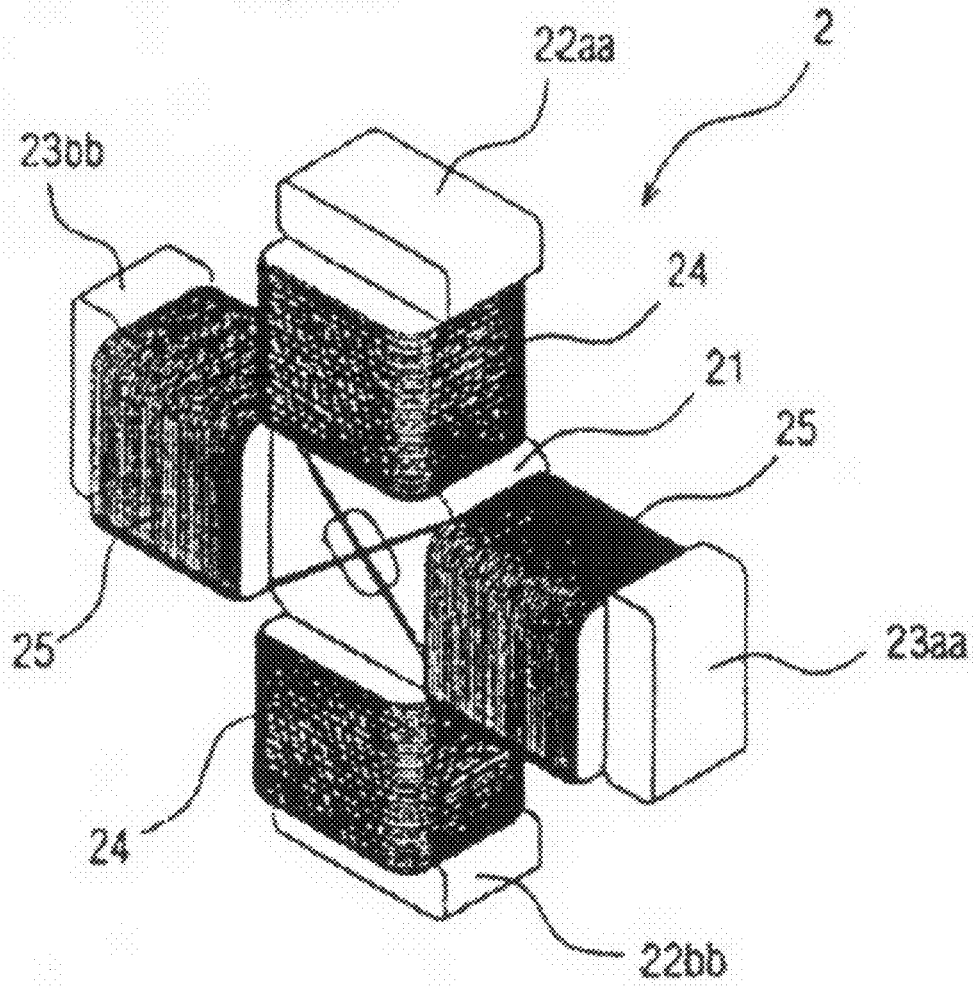
FIG. 5 is a perspective diagram of the three-axis antenna pursuant to the present invention.

The following structure is adopted in this embodiment. X-axis winding wire 24 is wound about X-axis arms 22*a*, 22*b* and Y-axis winding wire 25 is wound about Y-axis arms 23*a*, 23*b* in cross-shaped core 2, as shown in FIG. 5. The winding method of X-axis winding wire 24 and of Y-axis winding wire 25 is explained here. S shown in FIG. 6 (*a*) represents the winding origin, with X-axis winding wire 24 proceeding in the direction represented by the arrows. The winding range of X-axis winding wire 24 begins from the root section of X-axis arm 22*a* and proceeds toward head section 22*aa* of X-axis arm 22*a*, which is one arm (direction of arrow D1).

Figure 6:
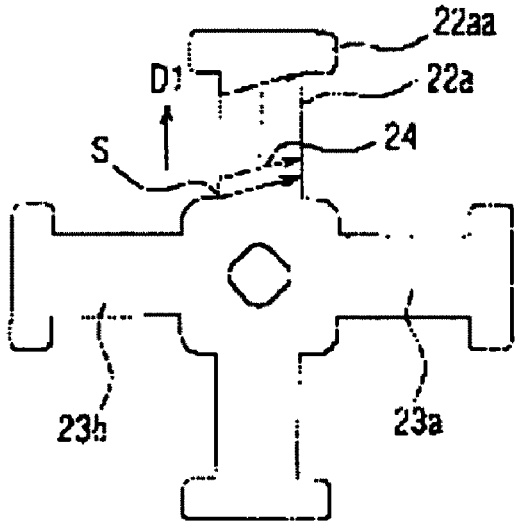
FIG. 6 is a perspective diagram showing the method of winding the three-axis antenna pursuant to the present invention.
Figure 6:
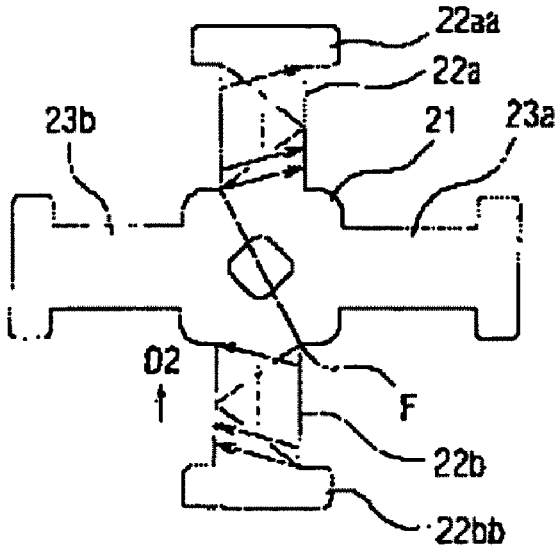

When winding reaches the boundary section with head section 22*aa*, as shown by the arrows denoting the winding in FIG. 6 (*b*), it proceeds from head section 22*aa* to the intermediate point of X-axis arm 22*a* with the root section and then straddles base section 21, after which it continues to the side of head section 22*bb* of X-axis arm 22*b* without winding about head section 22*bb* via the intermediate point with the root section of X-axis arm 22*b* which is the other arm, after which winding of X-axis winding wire 24 resumes from the boundary section of head section 22*bb*, which is the spanning destination. Here, the winding range of X-axis winding wire 24 begins from the boundary section with head section 22*bb* of X-axis arm 22*b* and then proceeds toward the root section of X-axis arm 22*b* (direction of arrow D2).

When winding is continued, it returns to winding origin S shown in FIG. 6 (*a*) and then proceeds as explained using FIG. 6 (*a*) and FIG. 6 (*b*). Ultimately, the winding terminates at the winding terminus F shown in FIG. 6 (*b*). The winding method of Y-axis winding wire 25 proceeds in the identical manner as that of X-axis winding wire 24. Winding is carried out via the procedures of aforementioned FIG. 6 (*a*) and FIG. 6 (*b*) after turning FIG. 6 by 90 degrees counter-clockwise.

The end of X-axis winding wire 24 is caught by projection tab 43 of retaining tab 4 corresponding to head sections 22*aa*, 22*bb*, respectively. The edge of this coil is connected by soldering to the terminals that extend from external terminals 31-38 to the vicinity of projection tab 43. Similarly, the end of Y-axis winding wire 25 is caught by projection tab 43 of retaining tab 4 corresponding to head sections 23*aa*, 23*bb*, respectively. The edge of this coil is connected by soldering to the terminals that extend from external terminals 31-38 to the vicinity of projection tab 43.

Figure 7:
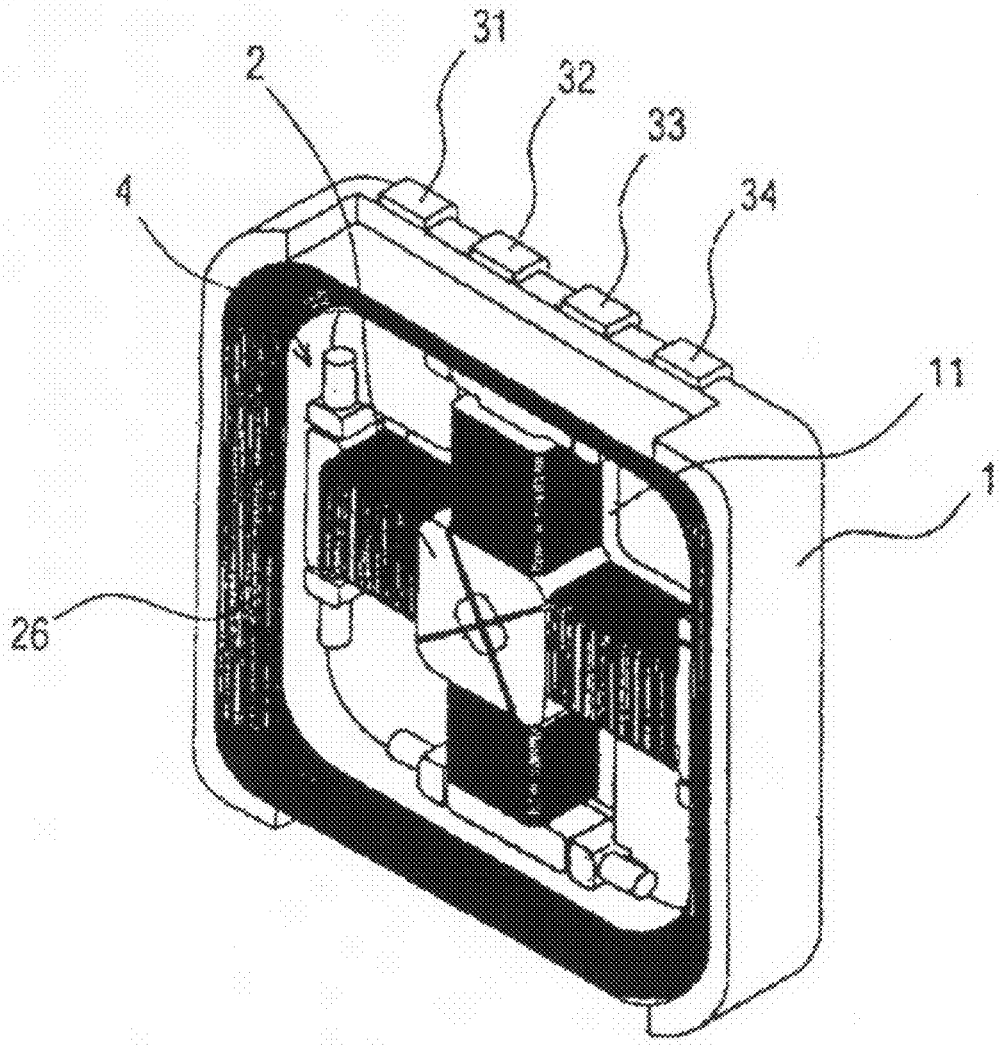
FIG. 7 is a perspective diagram of the condition in which winding wire is not wound in the antenna coil unit pursuant to the present invention.

Z-axis winding wire 26 is wound about an empty core in a virtually square shape, as shown in FIG. 7. It is disposed in a ring-shaped passage formed along the inner wall of case 1 to which it is fixed. Of course, the winding shape of Z-axis winding wire 26 is not restricted to square shape. Other suitable shapes are permitted, such as round or oval. Cross-shaped core 2 about which is wound X-axis winding wire 24 and Y-axis winding wire 25 is disposed as shown in FIG. 7. As a result, Z-axis winding wire 26 is installed in a virtually square shape so as to enclose the outside of head sections 22*aa*, 22*bb* of X-axis arms 22*a*, 22*b* and the outside of head sections 23*aa*, 23*bb* of Y-axis arms 23*a*, 23*b* (FIG. 1, FIG. 7). Z-axis winding wire is installed in a condition so as to cover the entire head surfaces of X-axis arms 22*a*, 22*b* and the head surfaces of Y-axis arms 23*a*, 23*b* in cross-shaped core 2.

The edges of external terminals 35, 36 that are installed on the outside of case 1 protrude near the position where Z-axis winding wire 26 is disposed in case 1, and each end of Z-axis winding wire 26 is connected. In addition, the edges of external terminals 37, 38 that are installed on the outside protrude near cross-shaped core 2 that is disposed at the bottom of case 1, and are connected to the center taps of X-axis winding wire 24 and Y-axis winding wire 25.

Figure 8:
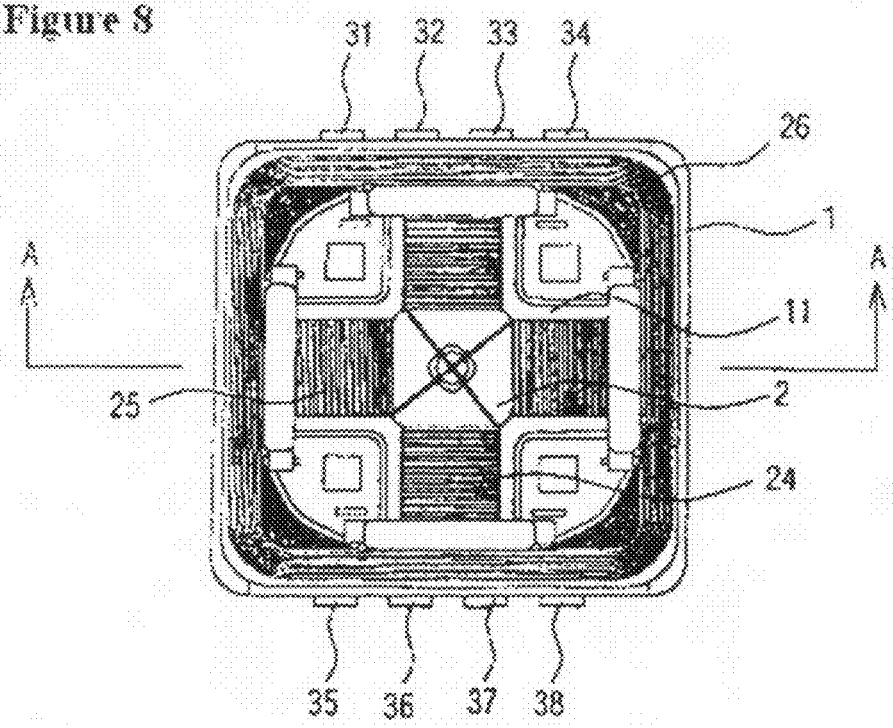
FIG. 8 is a front view showing an embodiment of the antenna coil unit pursuant to the present invention.
Figure 9:
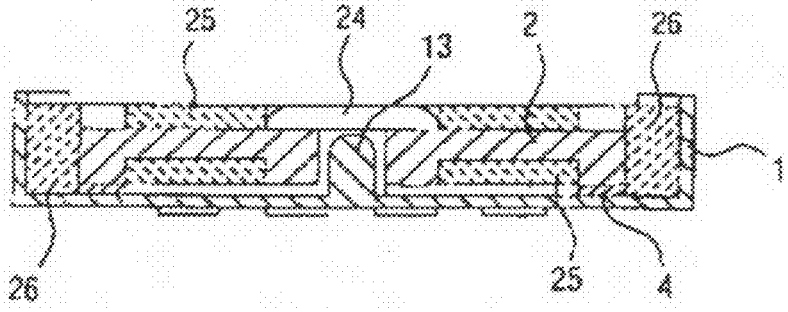
FIG. 9 is a cross-sectional view of the antenna coil unit pursuant to the present invention shown in FIG. 8.

A completed diagram of the three-axis antenna presents the structure in the planar figure that is FIG. 8. A cross-sectional view along A-A of FIG. 8 is shown in FIG. 9. The potentials of windings 24, 25 are equal on the sides of head sections 22*aa*, 22*bb* of a pair of X-axis arms 22*a*, 22*b* and on the sides of head sections 23*aa*, 23*bb* of a pair of Y-axis arms 23*a*, 23*b* since X-axis winding wire 24 and Y-axis winding wire 25 are wound as explained using FIG. 6. The effects of the electric fields of aforementioned X-axis winding wire 24 and Y-axis winding wire 25 relative to Z-axis winding wire 26 that is installed in virtually square shape on the outside of head sections 22*aa*, 22*bb* of X-axis arms 22*a*, 22*b* and of head sections 23*aa*, 23*bb* of Y-axis arms 23*a*, 23*b* are equalized, thereby allowing sensitivity to be attained without deviation concerning Z-axis winding wire 26.

Figure 11:
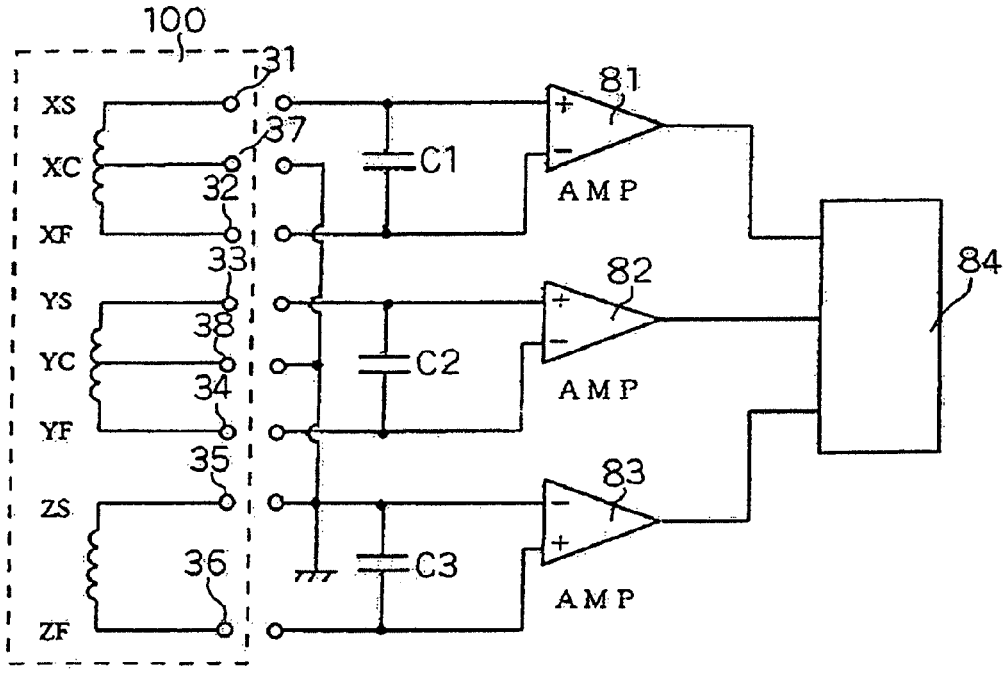
FIG. 11 is a circuit diagram showing the first embodiment of the receiving device pursuant to the present invention.

FIG. 11 shows the structure of the receiving device using antenna coil unit 100 fitted with the three-axis antenna having aforementioned structure. It is provided with first amplifier 81 connected to external terminal 31 that is connected to the winding origin edge XS of X-axis winding wire 24 and to external terminal 32 that is connected to the winding terminus edge XF, second amplifier 82 connected to external terminal 33 that is connected to the winding origin edge YS of Y-axis winding wire 25 and to external terminal 34 that is connected to the winding terminus edge YF, and third amplifier 83 connected to external terminal 35 that is connected to the winding origin edge ZS of Z-axis winding wire 26 and to external terminal 36 that is connected to the winding terminus edge ZF.

First amplifier 81 is provided with capacitor C1 that is connected between two input terminals, second amplifier 82 is provided with capacitor C2 that is connected between two input terminals, and third amplifier 83 is provided with capacitor C3 that is connected between two input terminals. Reception selection circuit 84 that is provided treats the output from aforementioned first to third amplifiers 81 to 83 as received signals. In short, reception selection circuit 84 compares the output levels of amplifiers 81 to 83, selects the signal having the greater output level and outputs it to the processing circuit of the received signal. Terminals 37 and 38 that are connected to the center taps XC, YC of X-axis winding wire 24 and Y-axis winding wire 25 as well as terminal 35 that is connected to winding origin edge ZS of Z-axis winding wire 26 are grounded by common connection to the circuit board side. The suffixes of these connections XC, YC, ZS are represented by CCS. Thus, the grounding of center taps XC, YC with the terminal connected to winding terminus ZF of Z-axis winding wire 26 would be represented as CCF.

Figure 14:
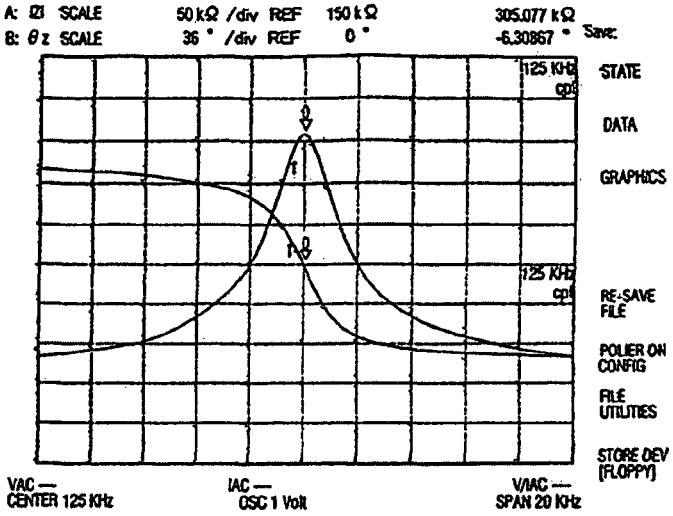
FIG. 14 is a diagram showing the frequency characteristics when conducting CCS connection shown in FIG. 11 in the receiving device pursuant to the present invention.
Figure 14:
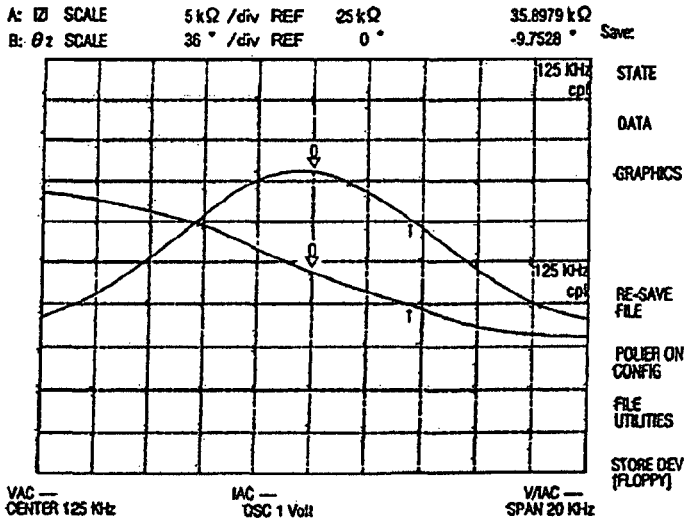
Figure 14:
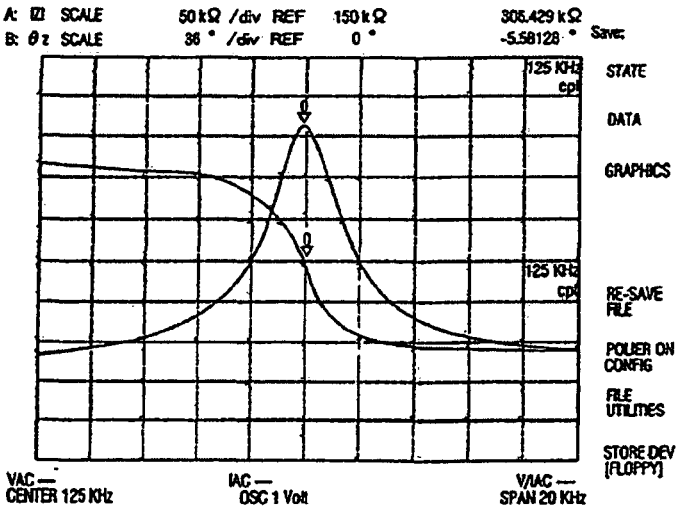
Figure 15:
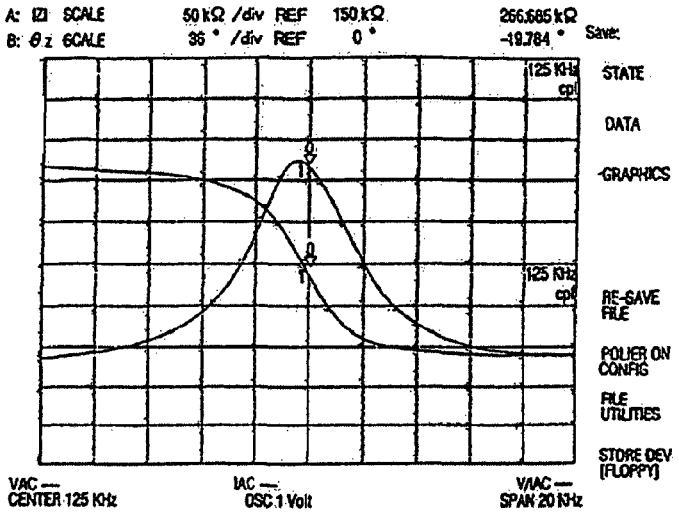
FIG. 15 is a diagram showing the frequency characteristics when conducting FFF connection different from FIG. 11 in the receiving device pursuant to the present invention.
Figure 15:
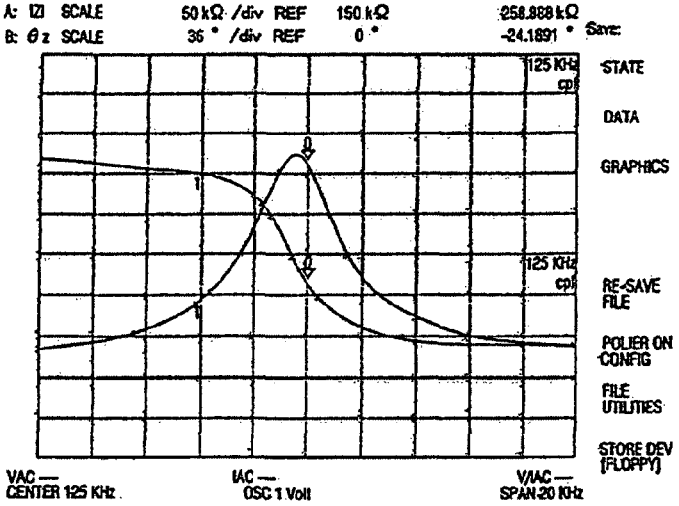
Figure 15:
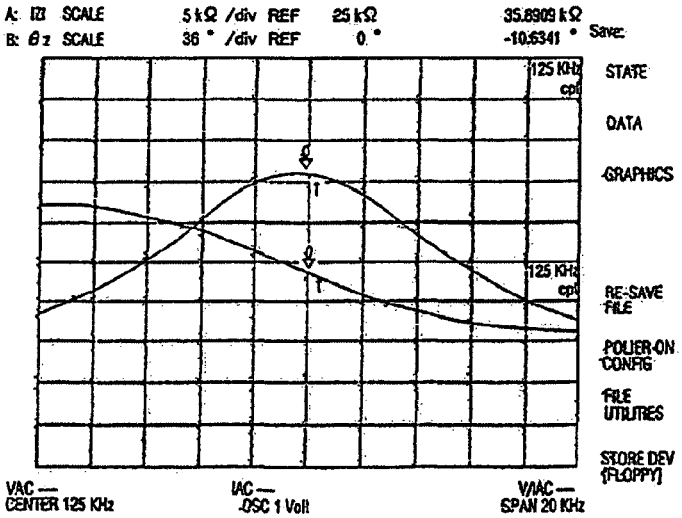

Thus, the connection of either edge XS, XF with either edge YS, YF and with either edge ZS, ZF without using center taps XC, YC with X-axis winding wire 24 and Y-axis winding wire 25 would be the connections represented by SSS, FFF, FFS, FSF, FSS, SFF, SFS, SSF. Comparative trials of these eight types of received sensitivity characteristics with the received sensitivity characteristics of aforementioned CCS show that the CSS connection provides the highest peak value and that the characteristics are arranged according to the peak frequency in the XYZ axes. In short, this indicates that characteristics having no deviation in three axes are obtained. FIG. 14 shows the case of a CCS connection while FIG. 15 shows the case of an FFF connection. The trial results in FIG. 15 indicate deviation of the central frequency due to coupling in the case of an FFF connection. The ordinate in each chart represents the impedance, with one calibration representing 50 KΩ. The abscissa is the frequency. The center of the abscissa is 134.2 KHz and the amplitude of the abscissa is 30 KHz. Tests on the characteristics of CCF revealed characteristics virtually identical with those of CCS.

Figure 12:
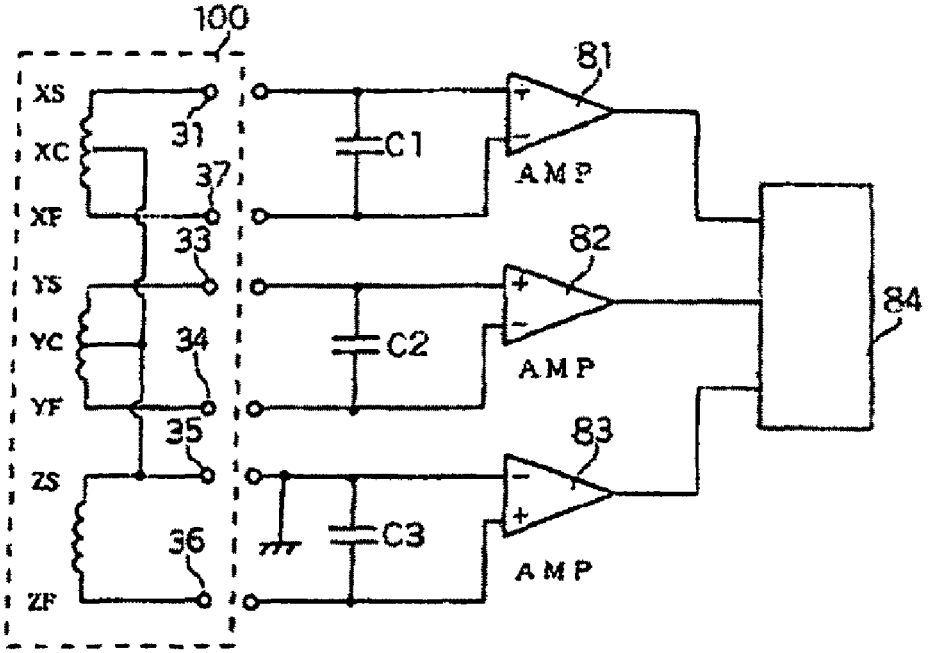
FIG. 12 is a circuit diagram showing the second embodiment of the receiving device pursuant to the present invention.
Figure 13:
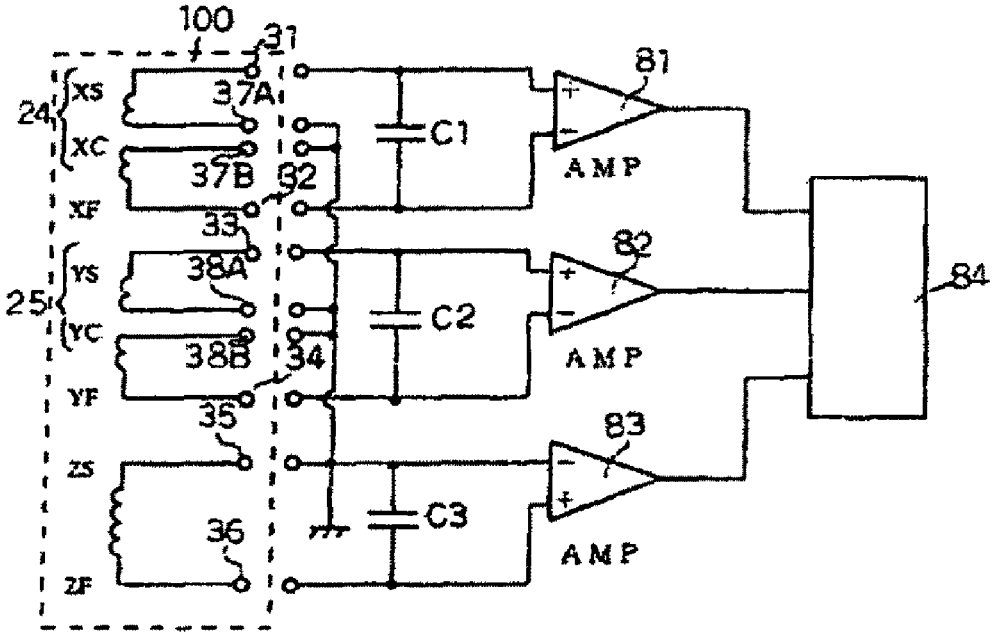
FIG. 13 is a circuit diagram showing the third embodiment of the receiving device pursuant to the present invention.

The structure shown in FIG. 11 is provided with eight terminals 31 to 38 in the three-axis antenna, but a structure in which a three-axis antenna is provided with six terminals in which terminals 37, 38 and terminal 35 have shared connections, as shown in FIG. 12, may be adopted. Furthermore, as shown in FIG. 13, X-axis winding wire 24 may be structured from two winding wires and Y-axis winding wire 25 may also be structured from two winding wires. A structure may be adopted in which the terminals 37A, 37B, 38A, 38B connected to the individual center taps XC, YC of X-axis winding wire 24 and Y-axis winding wire 25 are commonly connected with terminal 35 on the circuit board side for grounding.

An antenna coil unit provided with six external terminals can be implemented by incorporating capacitors C1 to C3 in case 1. In addition, an antenna coil unit that incorporates amplifiers 81 to 83 in case 1 can also be implemented. Furthermore, six terminals can be completed by collecting in one terminal each terminus of each winding wire connected to the ground.

Retaining tab 4 in FIG. 3 may have a structure that is integrated with cross-shaped core 2 so as to cover head sections 22*aa*, 22*bb*, 23*aa*, 23*bb* of cross-shaped core 2.

Fan shaped convex member 12 in case 1 shown in FIG. 2 is not restricted to this shape. Rectangular or round shapes are also permitted.

Figure 16:
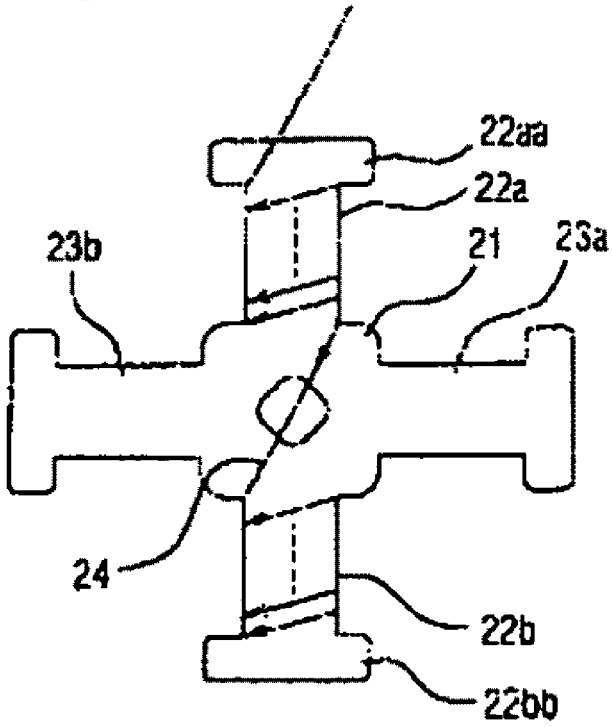
FIG. 16 is a perspective diagram showing the method of winding the three-axis antenna pursuant to the present invention.
Figure 17:
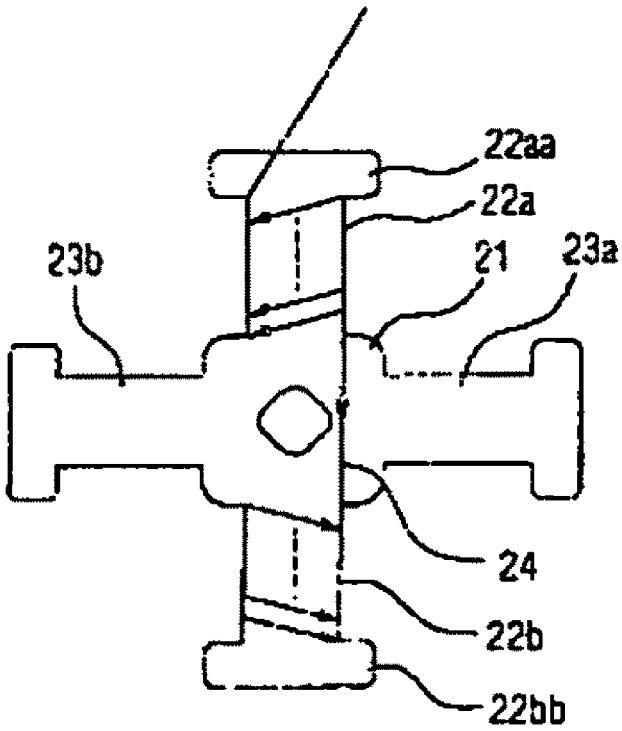
FIG. 17 is a perspective diagram showing the method of winding the three-axis antenna pursuant to the present invention.

Winding as shown in FIG. 16 and FIG. 17 may be adopted instead of the winding method of X-axis winding wire 24 shown in FIG. 6. Specifically, as shown in FIG. 16, the winding origin may be from head section 22*aa* of cross-shaped core 2, proceeding toward the root section of X-axis arm 22*a*, after which it diagonally straddles base section 21 and reaches the root section of X-axis arm 22*b*, the other arm, from which point the winding would proceed from the root section of aforementioned X-axis arm 22*b* toward the side of head section 22*bb* so that the magnetic flux directions due to winding wires that are wound about X-axis arms 22*a*, 22*b* would be consistent. In addition, as shown in FIG. 17, the winding origin may be from head section 22*aa* of cross-shaped core 2, proceeding toward the root section of X-axis arm 22*a*, after which it straddles base section 21 directly to the opposite side to reach the root section of X-axis arm 22*b*, the other arm, from which point the winding would proceed from the root section of aforementioned X-axis arm 22*b* toward the side of head section 22*bb* so that the magnetic flux due to winding wires that are wound about X-axis arms 22*a* and 22*b* would offset each other. In addition, any number of layers may be wound in bank winding from head section 22*aa* to the root section of X-axis arm 22*a*. Of course, the winding technique of winding wire from the root section of X-axis arm 22*b* to head section 22*bb* may be identical.

What is claimed is:

1. A receiving device provided with a three-axis antenna, the three-axis antenna comprising:

a cross-shaped core having a pair of X-axis arms projecting in an X-axis direction and a pair of Y-axis arms projecting in a Y-axis direction orthogonal to the X-axis direction in an orthogonal coordinate system, the X-axis arms comprising head sections, and the Y-axis arms comprising head sections;

X-axis winding wire wound about the X-axis arms;

Y-axis winding wire wound about the Y-axis arms;

Z-axis winding wire enclosing the cross-shaped core outside the head sections of the X-axis arms and the head sections of the Y-axis arms and so as to cover surfaces of the head sections of the X-axis arms and of the Y-axis arms of the cross-shaped core;

a first amplifier connected to first and second terminals that are electrically connected to a winding origin and to a winding terminus of the X-axis winding wire, respectively;

a second amplifier connected to third and fourth terminals that are electrically connected to a winding origin and to a winding terminus of the Y-axis winding wire, respectively;

a third amplifier connected to fifth and sixth terminals that are electrically connected to a winding origin and to a winding terminus of the Z-axis winding wire, respectively; and a reception selection circuit to receive signals output from any of the first to third amplifiers, wherein seventh and eighth terminals that are electrically connected to center taps of the X-axis winding wire and of the Y-axis winding wire, respectively, and the fifth terminal connected to the winding origin of the Z-axis winding wire are grounded.

2. The receiving device of claim 1, wherein the X-axis winding wire and Y-axis winding wire each begins at its respective winding origin at a root section of the X-axis or Y-axis arms, respectively, and extends toward the head section of the arm without encircling the head section, after which the winding wire spans to the head section of the opposite arm, from which point the winding wire continues toward its respective winding terminus at the root section.

3. The receiving device of claim 1, wherein the center taps of the X-axis winding wire and the Y-axis winding wire are electrically connected to a circuit board upon which the first, second, and third amplifiers have been installed.

* * * * *